US007766762B2

(12) United States Patent
Stellander

(10) Patent No.: US 7,766,762 B2
(45) Date of Patent: Aug. 3, 2010

(54) TRUE AIM PUTTER

(76) Inventor: Bernt Stellander, Skollenborgveien 64, N-3619 Skollenborg (NO)

( * ) Notice: Subject to any disclaimer, the term of this patent is extended or adjusted under 35 U.S.C. 154(b) by 0 days.

(21) Appl. No.: 12/278,403

(22) PCT Filed: Feb. 13, 2007

(86) PCT No.: PCT/NO2007/000047

§ 371 (c)(1),
(2), (4) Date: Aug. 6, 2008

(87) PCT Pub. No.: WO2007/094679

PCT Pub. Date: Aug. 23, 2007

(65) Prior Publication Data

US 2009/0029798 A1 Jan. 29, 2009

Related U.S. Application Data

(60) Provisional application No. 60/773,334, filed on Feb. 15, 2006.

(51) Int. Cl.
*A63B 69/36* (2006.01)

(52) U.S. Cl. ..... 473/251; 473/253; 473/254

(58) Field of Classification Search ..... 473/251–254; D21/736–746
See application file for complete search history.

(56) References Cited

U.S. PATENT DOCUMENTS 3,880,430 A * 4/1975 McCabe ..... 473/253
4,032,156 A * 6/1977 Clarke ..... 473/253
4,128,244 A 12/1978 Duclos
4,136,877 A * 1/1979 Antonious ..... 473/254
D256,262 S * 8/1980 Benson ..... D21/745
4,343,472 A * 8/1982 Hamilton ..... 473/240
4,458,900 A * 7/1984 Antonious ..... 473/254
4,629,193 A 12/1986 Pierman
4,986,544 A * 1/1991 Benson ..... 473/254
5,273,282 A * 12/1993 Cannon ..... 473/252
5,275,412 A * 1/1994 Innes ..... 473/253
5,462,279 A * 10/1995 Culpepper ..... 473/248
5,538,249 A * 7/1996 Benson ..... 473/254
5,846,140 A * 12/1998 Hoburg ..... 473/240
5,916,035 A * 6/1999 Caiozzo ..... 473/252
5,921,868 A * 7/1999 DiMartino ..... 473/254
6,062,986 A * 5/2000 Kaise ..... 473/242
6,261,190 B1 * 7/2001 Ashcraft ..... 473/251
6,558,268 B2 * 5/2003 Tindale ..... 473/244
6,846,245 B2 * 1/2005 Baron ..... 473/252

(Continued)

FOREIGN PATENT DOCUMENTS

GB 2149670 6/1985

(Continued)

*Primary Examiner*—Sebastiano Passaniti
(74) *Attorney, Agent, or Firm*—Christian D. Abel

(57) ABSTRACT

The putter according to the invention comprises a putter head having a forward-facing striking surface, a heel, a toe, a top surface and a rear alignment section. The rear alignment section comprises one or more elongated indicator bars of uniform width that project backwards and that are arranged perpendicularly to the striking surface at a first upper level. Arranged at a second, lower level is a corresponding number of elongated warning strips of a contrasting color, each warning strip having approximately the same width as, and being arranged in vertical alignment with, its corresponding elongated indicator bar.

8 Claims, 11 Drawing Sheets

U.S. PATENT DOCUMENTS

| | | | | |
|---|---|---|---|---|
| 7,001,284 | B2 * | 2/2006 | Edel | 473/252 |
| 7,052,409 | B2 * | 5/2006 | Goldsmith | 473/242 |
| 7,226,362 | B1 * | 6/2007 | Schell et al. | 473/238 |
| 7,393,285 | B2 * | 7/2008 | Stellander | 473/251 |
| 7,485,047 | B2 * | 2/2009 | Evans | 473/249 |
| 2003/0186756 | A1 | 10/2003 | Baron | |
| 2004/0266543 | A1 | 12/2004 | Goldsmith | |
| 2006/0229137 | A1 * | 10/2006 | McCarthy | 473/251 |
| 2008/0261718 | A1 * | 10/2008 | O'Neill | 473/340 |
| 2009/0017933 | A1 * | 1/2009 | Stites et al. | 473/254 |

FOREIGN PATENT DOCUMENTS

| | | |
|---|---|---|
| JP | 54156737 | 12/1979 |
| JP | 02068080 | 3/1990 |
| JP | 2006326216 | 12/2006 |

* cited by examiner

TRUE AIM PUTTER

This application claims the benefit under 35 USC §119(e) to U.S. Provisional Application 60/773,334 filed, 15 Feb. 2006.

FIELD OF THE INVENTION

The present invention relates to golf clubs and, more particularly to a putter with an alignment means that provides visual feedback during the setup and the stroke itself.

BACKGROUND OF THE INVENTION

A putter is a golf club used on the short-surface of a golf course, called the green. The putter is used to strike the ball along the surface of the green into the hole in a golf shot known as the "putt".

There are two critical phases in executing a proper putt. In order to putt accurately, the player needs to (a) achieve a proper stance and setup and to (b) properly execute the stroke.

The proper stance/Set up for putting includes:

1) The player positioning his/her feet and body parallel to the aiming/putting line. This imaginary straight line goes from the center of the hole, to the center of the ball, on a flat, horizontal surface. On undulating greens, this straight line is aimed to the side of the hole.
2) Before the stroke is performed, the putter should be positioned towards the back of the ball, so that the face is square to/perpendicular to the aiming/putting line. Then the center line of the putter is in line with the aiming/putter line. The center line of the putter is an imaginary line, dividing the putter in two equal halves, from front/face to back.
3) The putter should be placed behind the ball so that the ball is positioned on the center of the putter/face.
4) The players eyes should be positioned parallel to, and perpendicularly above the center line of the putter when the player is in position to perform the stroke (set up position).

Once the proper stance is achieved, the stroke must be executed. The correct/optimal stroke when using a pendulum-type putter is a "straight back-straight through" movement of the club head. During the stroke the player's head should not move.

Because of the exacting nature of putting, several efforts have been made to design a putter with an alignment system to help improve putting accuracy. Examples of such putters include U.S. Pat. Nos. 5,720,668; 6,200,227; 6,261,190; and 6,663,496. These patents are representative of alignment systems that assist the player in achieving a proper stance, and include visual means that aid the player in confirming that his/her head is directly above the putter during set up. While these putters and other known putters may be somewhat effective in aiding the player to position himself directly above the ball, none of these putters provide adequate visual feedback during the stroke itself. Nor do they take into consideration the effect of one's dominant eye on the visual feedback. In addition, many of these putters do not have adequate contrast so the peripheral vision can detect misalignment. The player has to move his focus to the indicators to check his eyes position at set up. There exists therefore a need for a putter that aids the player in both of these critical phases, and that aids the player in assuming a set up with eyes parallel over the club head along the vertical plane of the target line.

BRIEF SUMMARY OF THE INVENTION

The present invention is an alignment system that provides reference markings for achieving a proper set up position detectable in the peripheral vision, as well as providing visual feedback through the user's peripheral vision during the stroke itself. The reference markings of the putter aid the user in positioning his/her head directly over the ball and the center of the clubhead when ball is correctly placed at center in front of the putter head, and aid in centering the ball on the striking surface of the putter. The markings further aid the player in keeping the centerline of the putter parallel with the aiming/putting line from set up throughout the stroke.

The putter according to the invention comprises a putter head having a forward-facing striking surface, a heel, a toe, a top surface and a rear alignment section. The rear alignment section comprises one or more elongated indicator bars of uniform width that project backwards and that are arranged perpendicularly to the striking surface at a first upper level. Arranged at a second, lower level is a corresponding number of elongated warning strips of a contrasting color, each warning strip having approximately the same width as, and being arranged in vertical alignment with, its corresponding elongated indicator bar.

Three alternate embodiments are described herein:

According to one aspect of the invention, one indicator bar is located at the upper level, and one warning strip is located on the lower level. In a preferred embodiment the warning strip is formed as an intermediate region between two elongated strips having the same color as the indicator bar. When viewed from directly above, the intermediate region will thus be obscured by the indicator bar. In this preferred embodiment, a rectangular marking is provided on the top surface of the putter head, the marking being centered with and having the same color as the indicator bar. The width of the marking is approximately equal to the distance between the outside edges of the two elongated strips on the lower level, such that, when viewed directly from above, the indicator strip conceals the warning strip, and the rectangular marking, the indicator bar and the two elongated strips combine visually to form a solid rectangle. Alternatively, the indicator bar may be slightly longer than the two elongated strips on the lower level, such that a portion of the indicator bar extends beyond the rear side of the aforementioned rectangle. As can be appreciated, a visual warning will appear when the user is not aligned directly above the putter, as the misalignment will cause the warning strip to become visible, and the perceived rectangle to become disjointed.

The second embodiment is essentially an inversion of the first embodiment, with two indicator bars on the upper level, and two warning strips on lower level. In this embodiment the region between warning strips on the lower level will have the same color as the indicator bar. The space between the two indicator bars will thus form a slot that will be visually filled by the region between the warning strips when viewed from above. In this embodiment, the rectangular marking on the putter's top surface will have the same width as the distance between the outside edges of the two indicator bars, and will thus form a visual image of a solid rectangle when viewed from above in a similar manner as in the first embodiment.

The third embodiment comprises a single indicator bar on the upper level and a single warning strip on the lower level of a window member. In this embodiment, the warning strip is a preferably concave curved surface, but may also be a flat surface. In this embodiment, the warning strip will obscured by the indicator bar when viewed from above giving the impression of a solid rectangle. When misaligned, however, the warning strip will become visible. The concave curvature will give the visual appearance of a curved bulge appearing on the side of the misalignment. If a flat surface is used, the edge of the warning strip will appear.

In all the embodiments, correct alignment of the user results in the alignment system of the invention appearing as an image of one single and solid rectangular alignment marking, with no warning color or gaps appearing. With a level club head this indicates perfect eyes position over the club head, perpendicular above a vertical plane passing through the ball center and the target line.

The indicator path of the putter also provides improved visual feed back during the stroke itself. When the user properly executes the putting stroke by moving the putter straight back and straight through (i.e. parallel to the putting/aiming line), the parallel appearance of the solid path imparts a good visual feedback of the motion of the club head during the stroke. If the stroke deviates from the putting/aiming line, however, the user will receive immediate visual feedback. The user's peripheral vision will detect a break up of the solid path revealing gaps and an appearing warning color. Because visual perception is extremely sensitive to deviations from straight lines and parallel relationships, the user will be able to detect errors in the putting stroke better than with other known putters. Even better when the path is located right behind the focus of the eyes, which are on the back of the ball and in line and parallel to the aiming line along the center plane going from front to back. The closer to the eyes focus point (the back of the ball) the indicators are, the easier it is to detect the indicators, either correctly as one solid path, or the path breaking up and revealing gaps and a warning color. It is an elementary visual fact that the closer to the eyes focus point are to the image, the easier it is to detect the image in the peripheral vision.

DETAILED DESCRIPTION OF THE INVENTION

The present invention provides an alignment means for putter that will aid in improving putting accuracy. The following description is made with reference to a putter designed for a right-handed player wherein a hosel (not shown) will be provided at the appropriate location by one skilled in the art; however the invention may also be adapted for the left handed player by providing for an alternative location of the hosel by one skilled in the art.

Figure 1:
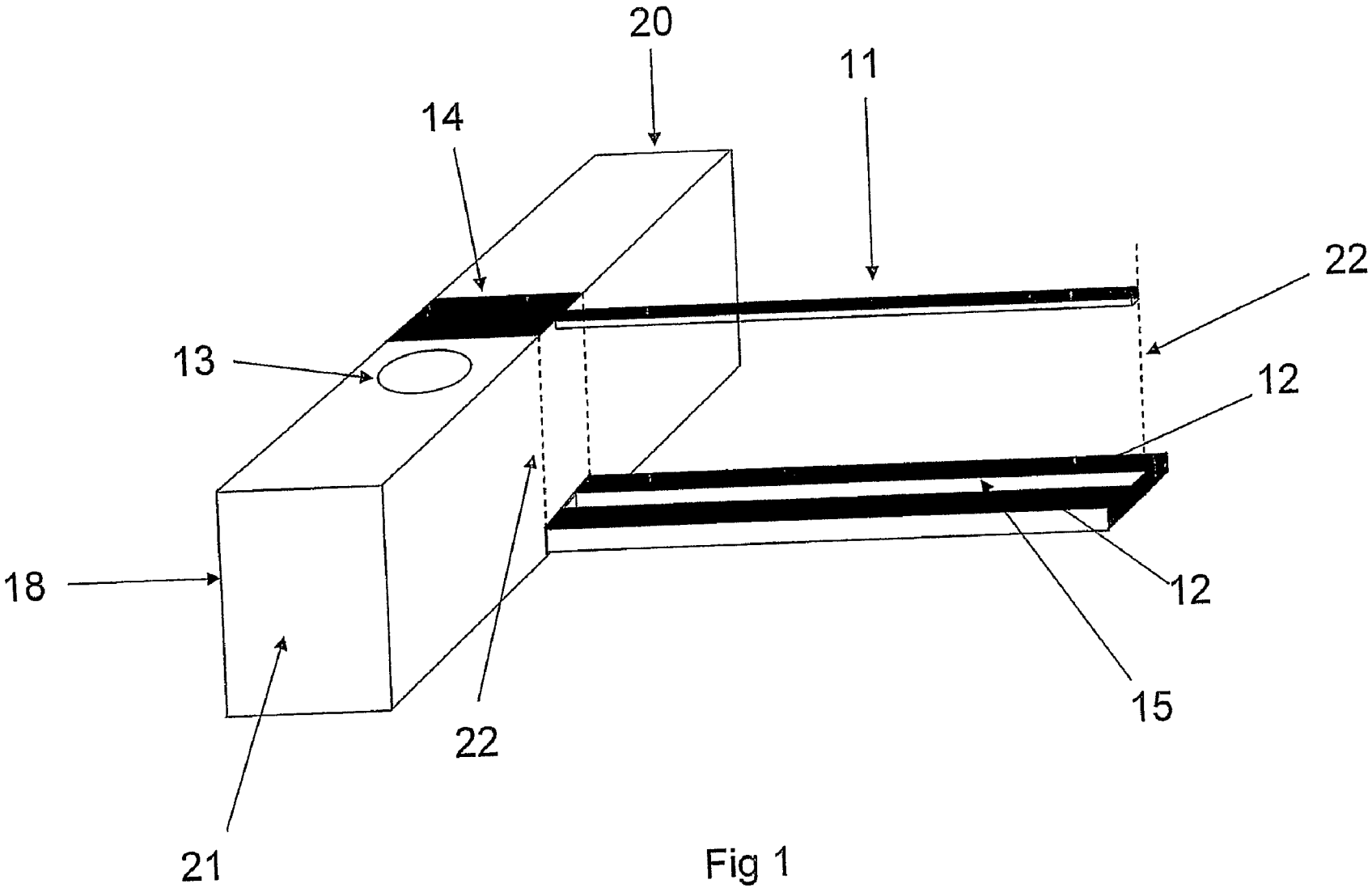
FIG. 1 is a side view, slightly perspective of alignment system alt. 1) indicators and the front part of the putter.

The preferred embodiment shown in FIG. 1 comprises a forward facing striking surface 18, a toe section 20, a heel section 21 (whereat a hosel will be provided for attachment of a shaft), and a rectangular marking 14 located on the putter's top surface. The putter further comprises a rear alignment section comprising one indicator bar 11 located at a first upper level, and two parallel elongated strips 12 on a second lower level, all three having uniform width and projecting backwards in perpendicular alignment with the striking surface. The elongated strips 12 are spaced apart from each other thus forming an intermediate region defining an elongated warning strip 15. Warning strip 15 is approximately the same width as, and in vertical alignment with, indicator bar 11. Elongated strips 12 have preferably the same color as indicator bar 11, and warning strip 15 preferably has a contrasting color. As shown in FIG. 3A, the width of rectangular marking 14 is approximately the same as the distance between the outside edges of elongated strips 12. Rectangular marking 14 is centered with indicator bar 11, such that, when viewed directly from above, marking 14, indicator bar 11 and elongated strips 12 will combine to form the visual image of a solid rectangle. As shown, indicator bar 11 may be slightly longer than elongated strips 12 such that a portion of indicator bar 11 extends past the rectangle. The widths of indicator bar 11, elongated strips 12 and warning strip 15 are preferably approximately equal to each other, and preferably between 2 mm-7 mm each, such that the visual rectangle will have a total width of from 6 mm to 21 mm.

Figure 6:
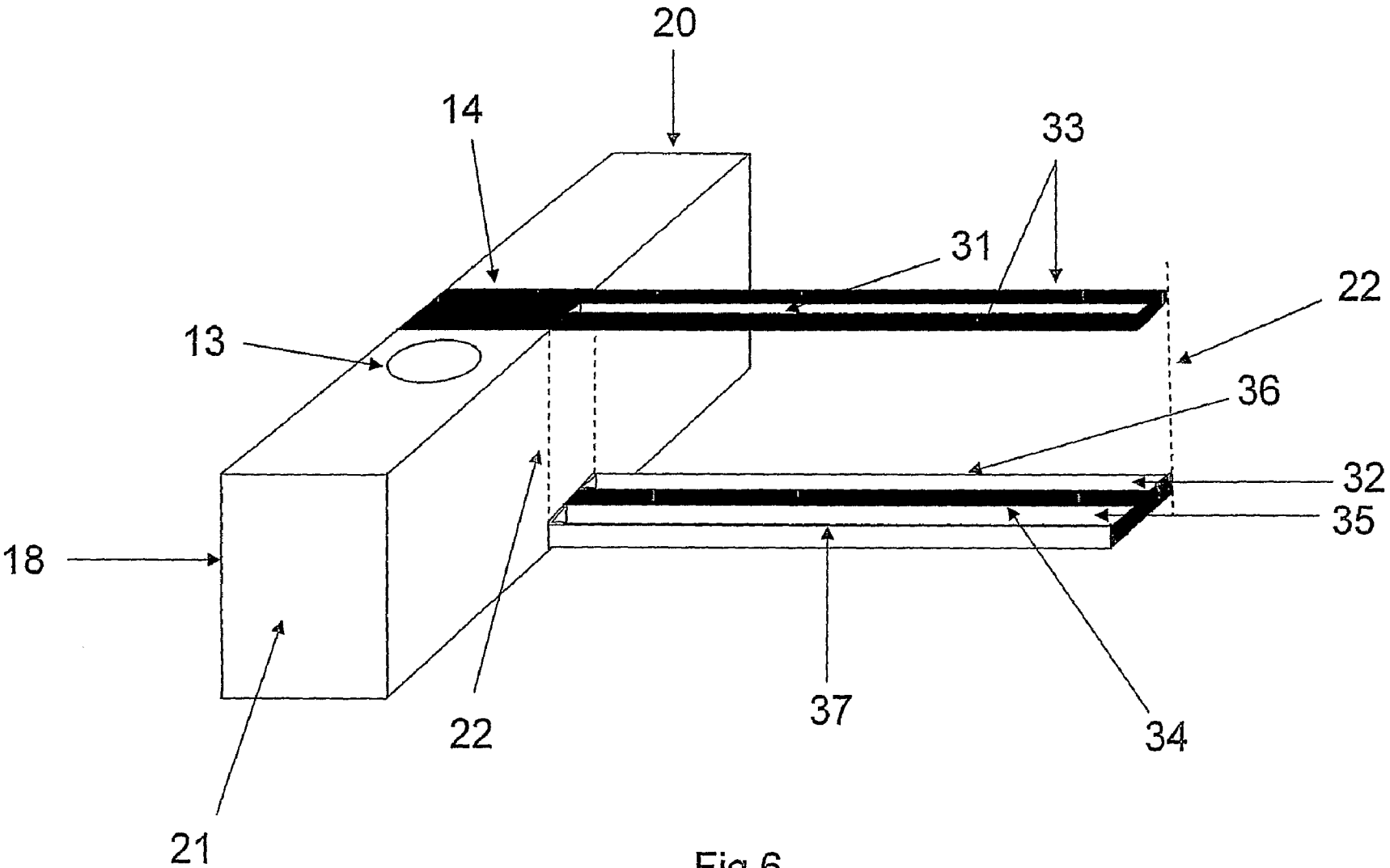
FIG. 6 is a side view, slightly in perspective of alignment system alt. 2).

An alternate embodiment shown in FIG. 6 comprises two parallel indicator bars 33 located on the upper level, spaced apart from each other forming a slot 31, and two parallel warning strips 32 and 35 located on the lower level. Warning strips 32 and 35 are spaced apart from each other defining an elongated strip 34. Elongated strip 34 has approximately the same width as slot 31. As in the first embodiment, the width of indicator bars 33, warning strips 32 and 35 and elongated strip 34 are all approximately equal, and the indicator strips and warning strips are in vertical alignment with each other. As shown in FIG. 9A, the width of rectangular marking 14 is approximately equal to the distance between the outside edges of indicator bars 33.

Figure 2:
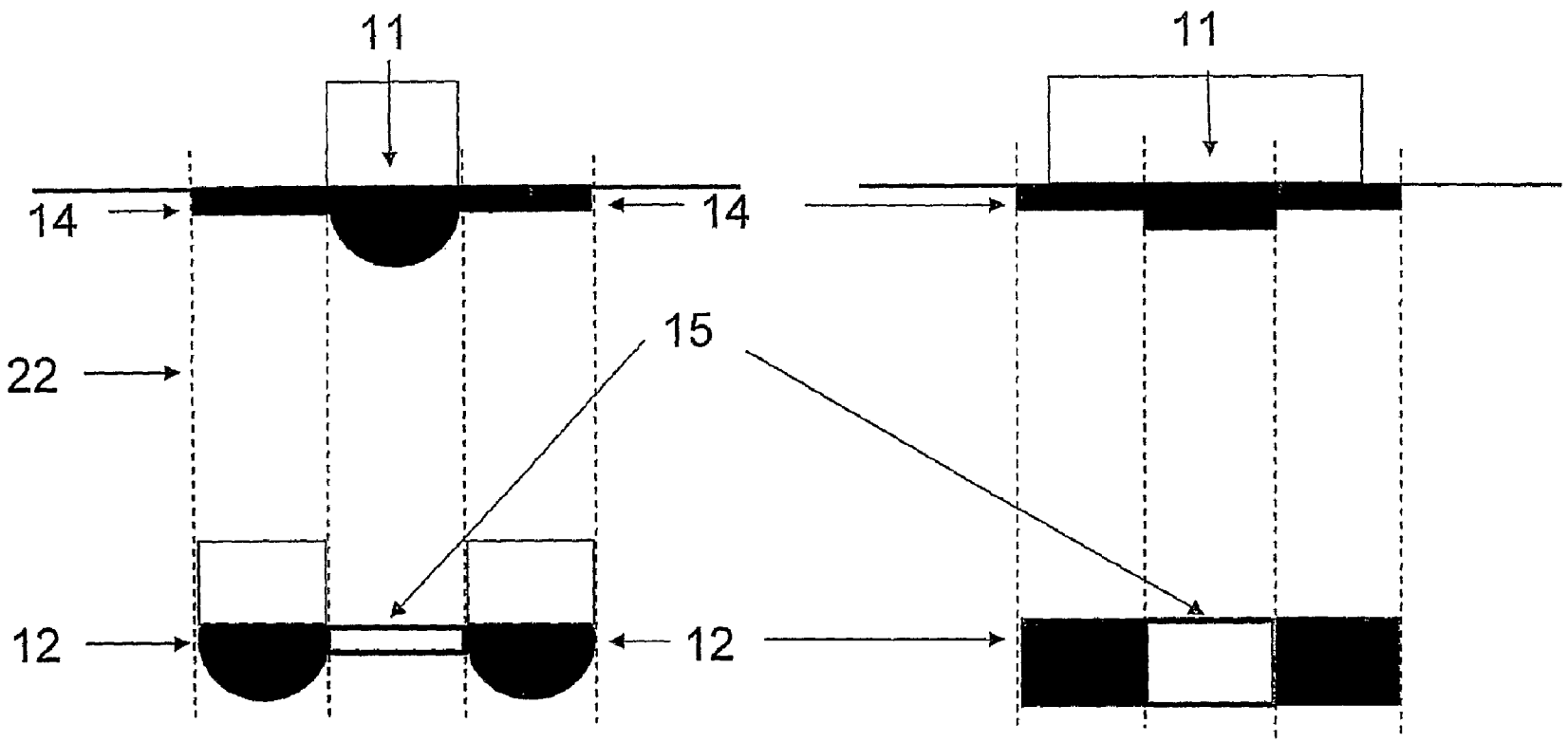
FIG. 2 is back view of alt. 1) showing two different ways to construct the parts of the alignment system, the indicator parts.

As shown in FIG. 2 the indicator bars and elongated strips may represent the upper surface of elongated members having either a semi-circular or rectangular cross section, and the warning strips may represent the lower surface of a groove or trough.

Figure 3:
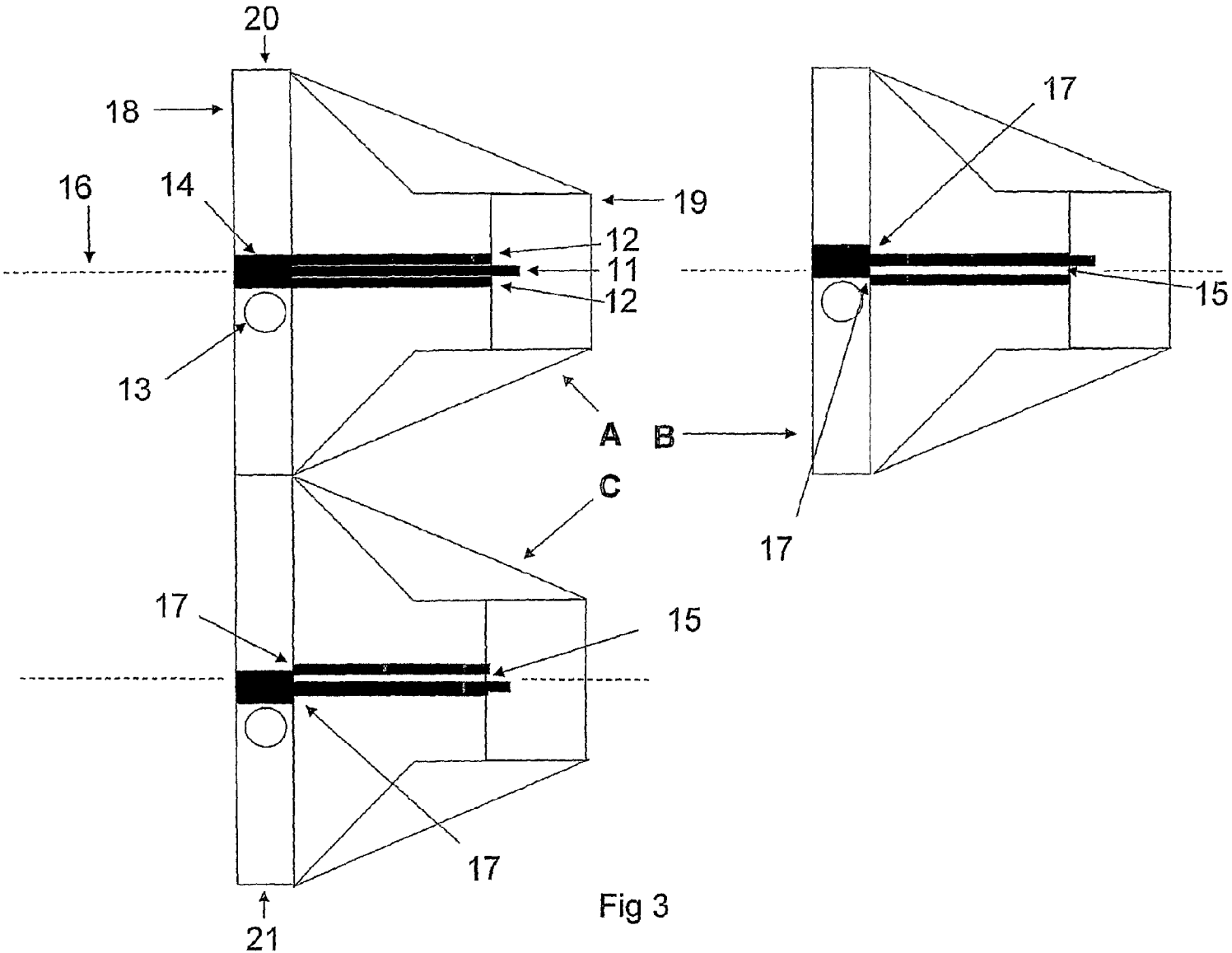
FIG. 3 is illustration of (A) perfect alignment, (B) eyes inside, and (C) eyes outside the club head of alt. 1) system.

FIG. 3 illustrates the operation of the invention from the first embodiment, showing three different visual images depending on eyes' position in relation to club head. FIG. 3A shows perfect position over the center of the club head. FIG. 3B shows the image when misaligned with eyes inside of the center vertical plane of the club head, going from front to back. FIG. 3C shows the image when eyes are misaligned to the outside of the club head center vertical plane. On both B and C we see two gaps appearing when misaligned 17, and also the warning strip 15 appearing.

Figure 4:
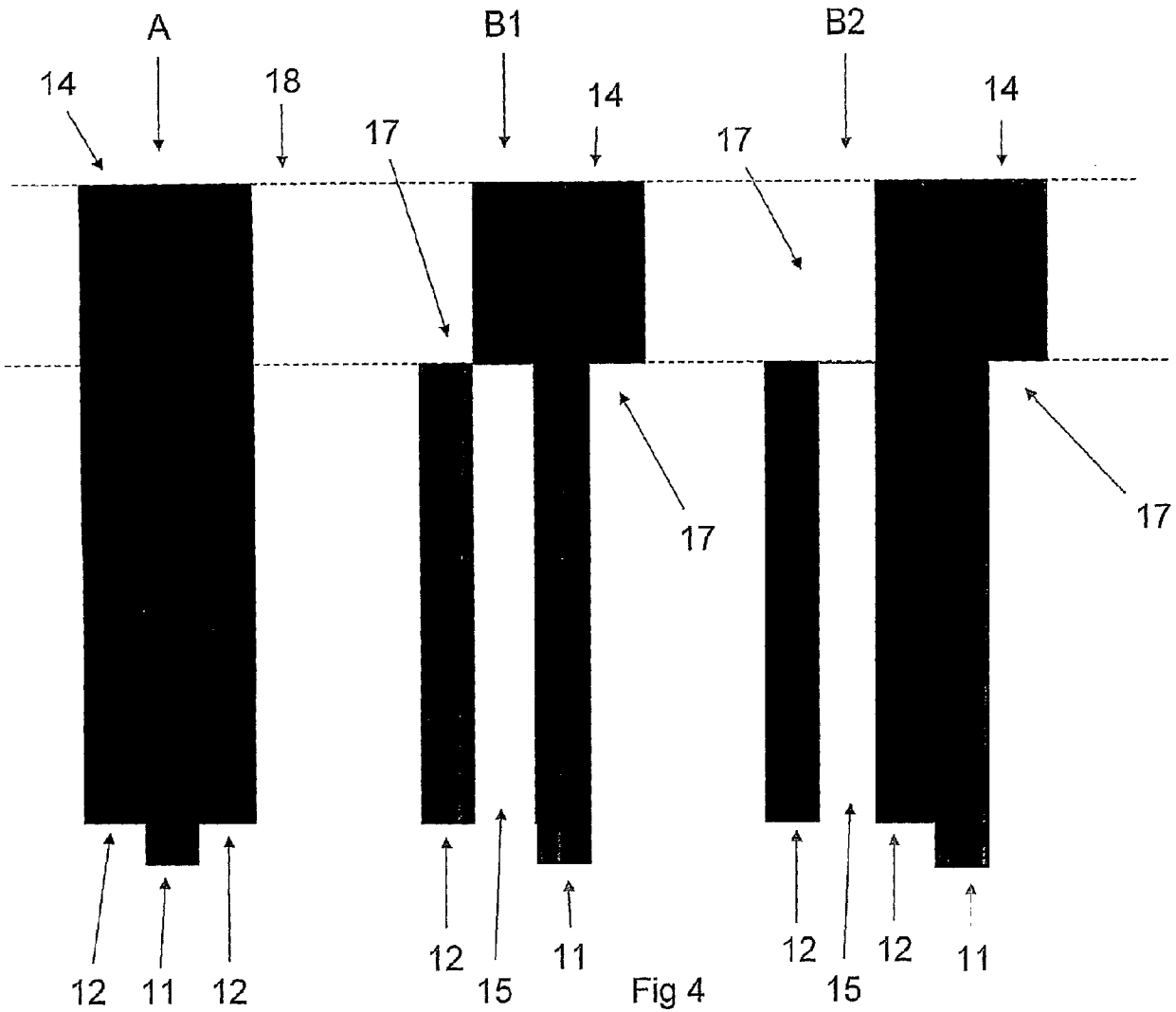
FIG. 4 is a sectional view of top view at different position of eyes in relation to club head. (A) perfectly aligned. (B1) to (B2) shows image of increased misalignment.

FIG. 4A shows a graphical representation of the first embodiment when eyes are properly aligned. FIG. B1 is the image when slightly misaligned to the inside, and FIG. B2 is the image when further or increased misalignment occurs. FIG. B1 shows the two gaps appearing 17 and the warning color appearing 15. FIG. B2 shows the inside gap increasing 17 and the total image breaks up even more than when slightly misaligned FIG. B1. The image distortion that increases when misalignment increases makes the system more sensitive than known alignment systems due to the fact that this increased distortion will increase the possibility to detect misalignment in the peripheral vision and the field of vision.

Figure 5:
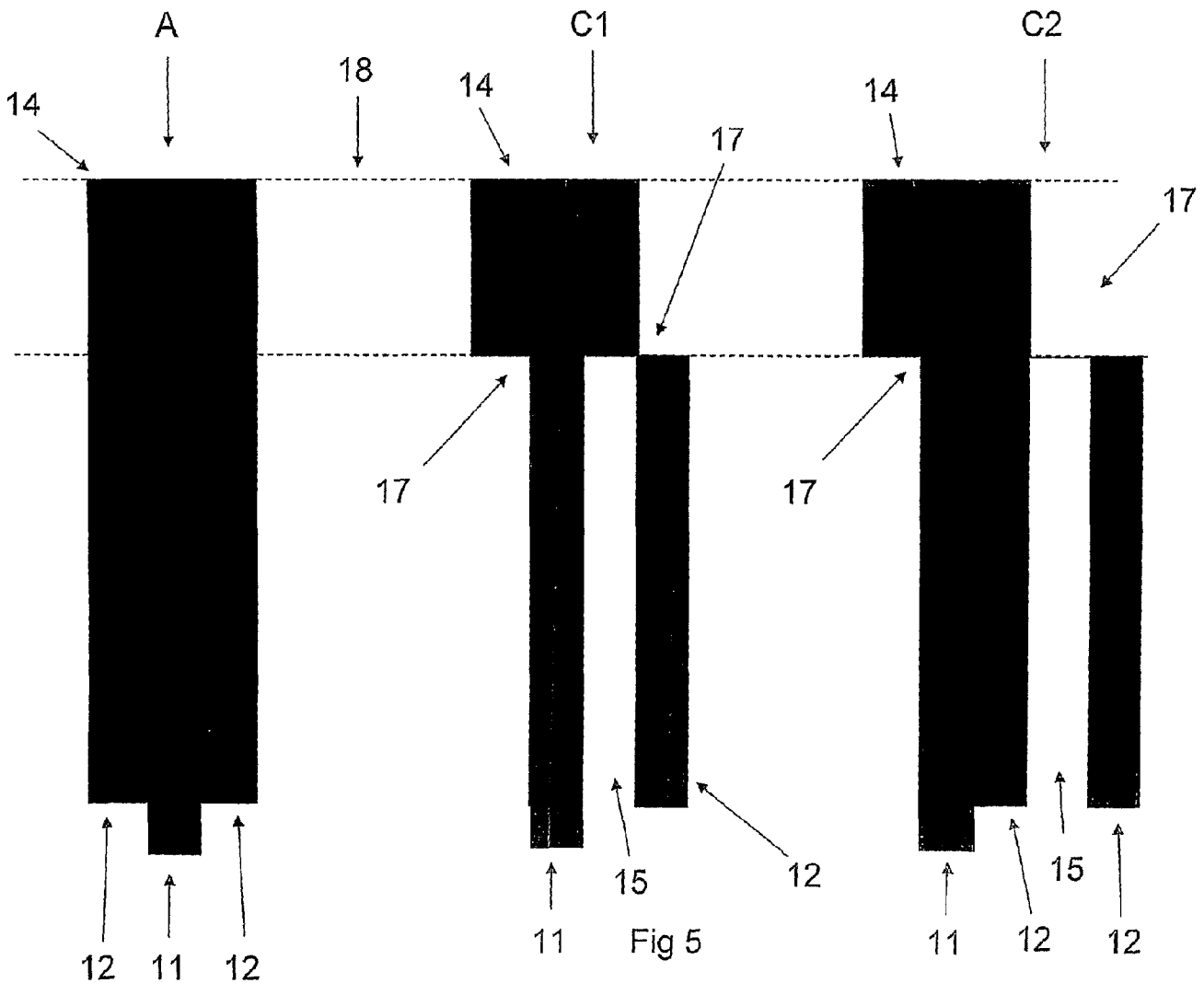
FIG. 5 Same as FIG. 4, but misaligned to the other side, eyes outside the putter.

FIG. 5A shows a graphical representation of the first embodiment when eyes are properly aligned. FIG. 5B shows the image when eyes are to the outside of the club head center vertical plane going from front to back. The same image distortion happens here as with FIG. 4, but reversed.

Figure 7:
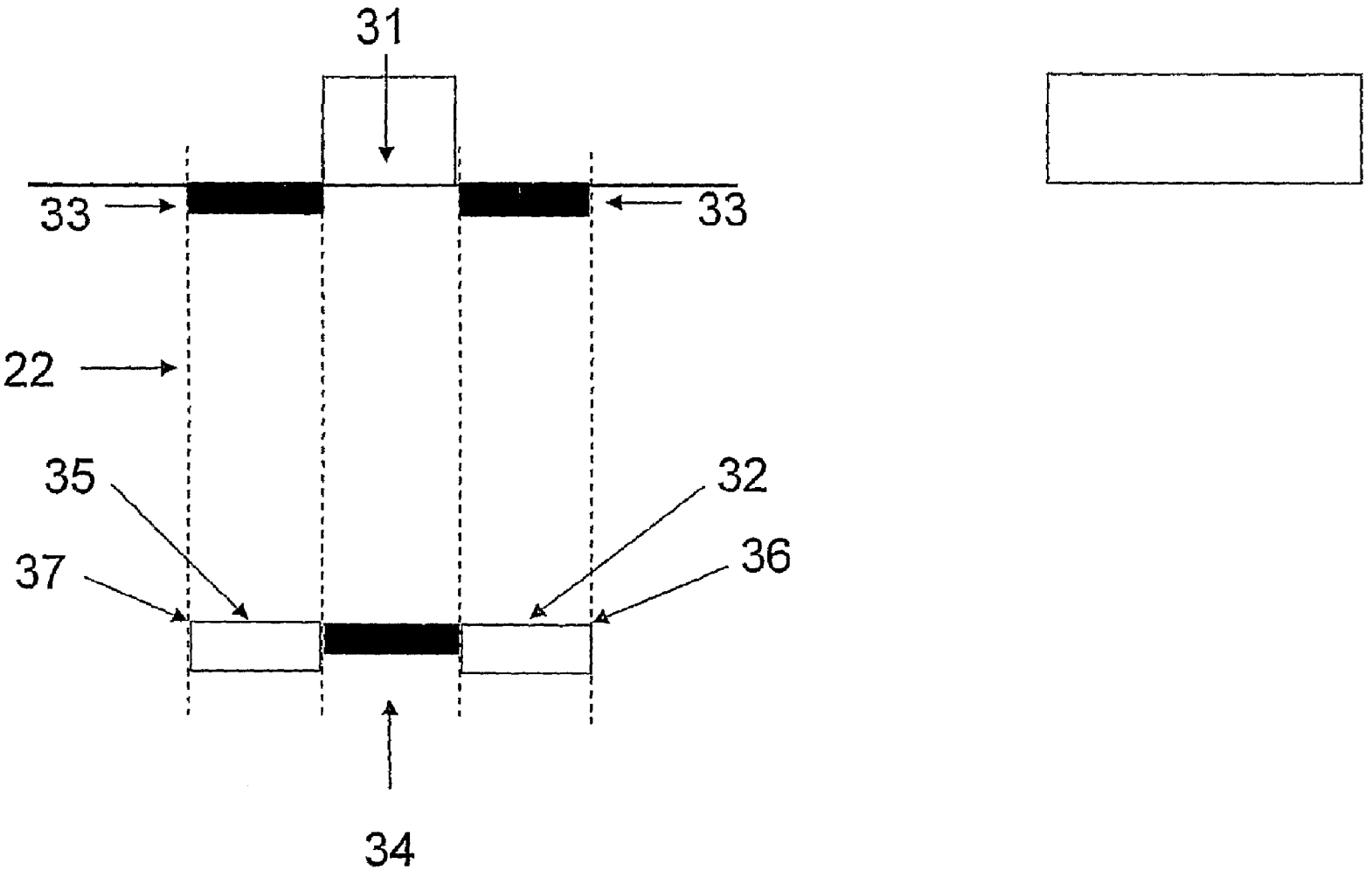
FIG. 7 is an illustration of the alt. 2) system viewed from the back.

FIG. 7 shows rear cross sectional view of the second embodiment, illustrating that the indicator bars and elongated strips may represent the top surface of elongated bodies having a rectangular cross section, and that the warning strips may represent the bottom surface of a groove or trough. The cross sections shown are only illustrative, and other cross sections are possible.

Figure 8:
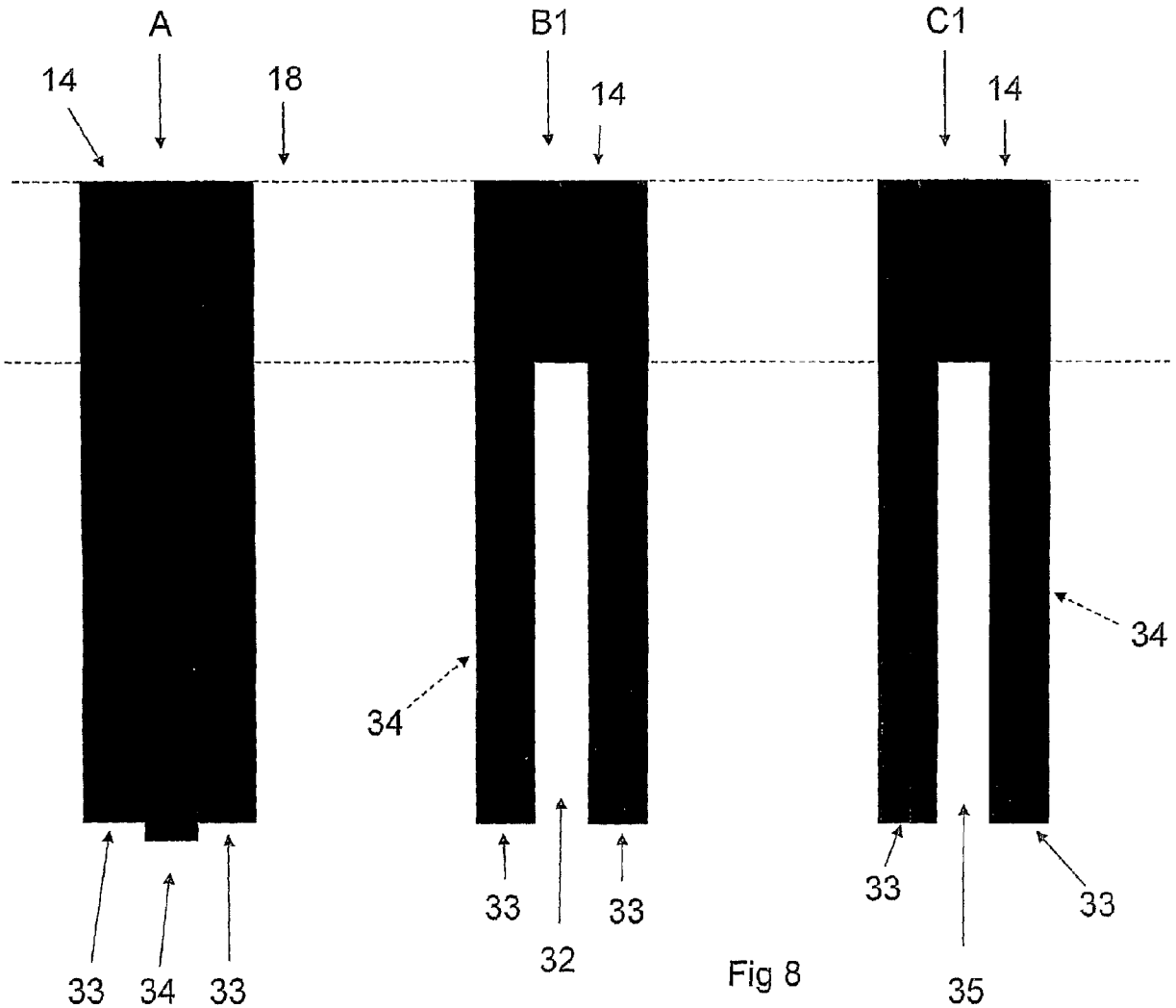
FIG. 8 is a sectional and top view of the alignment system alt. 2), slightly misaligned to either side, (B1) eyes inside and (C1) the eyes to the outside of the putter head.

FIG. 8 shows the visual image of the different positions of the eyes in relation to the club head of the second embodiment. FIG. 8A shown the image when eyes are perfectly above the club head center plane. FIG. B1 shows the image when eyes are slightly misaligned to the inside of the plane revealing the warning strip 32 on the right side. The lower elongated strip 34 is hidden under the upper left indicator bar 33. FIG. C1 shows the image when the eyes are to the outside of the vertical plane revealing the warning strip 35 on the left side. The lower elongated strip 34 is hidden under the upper right side indicator bar 33.

Figure 9:
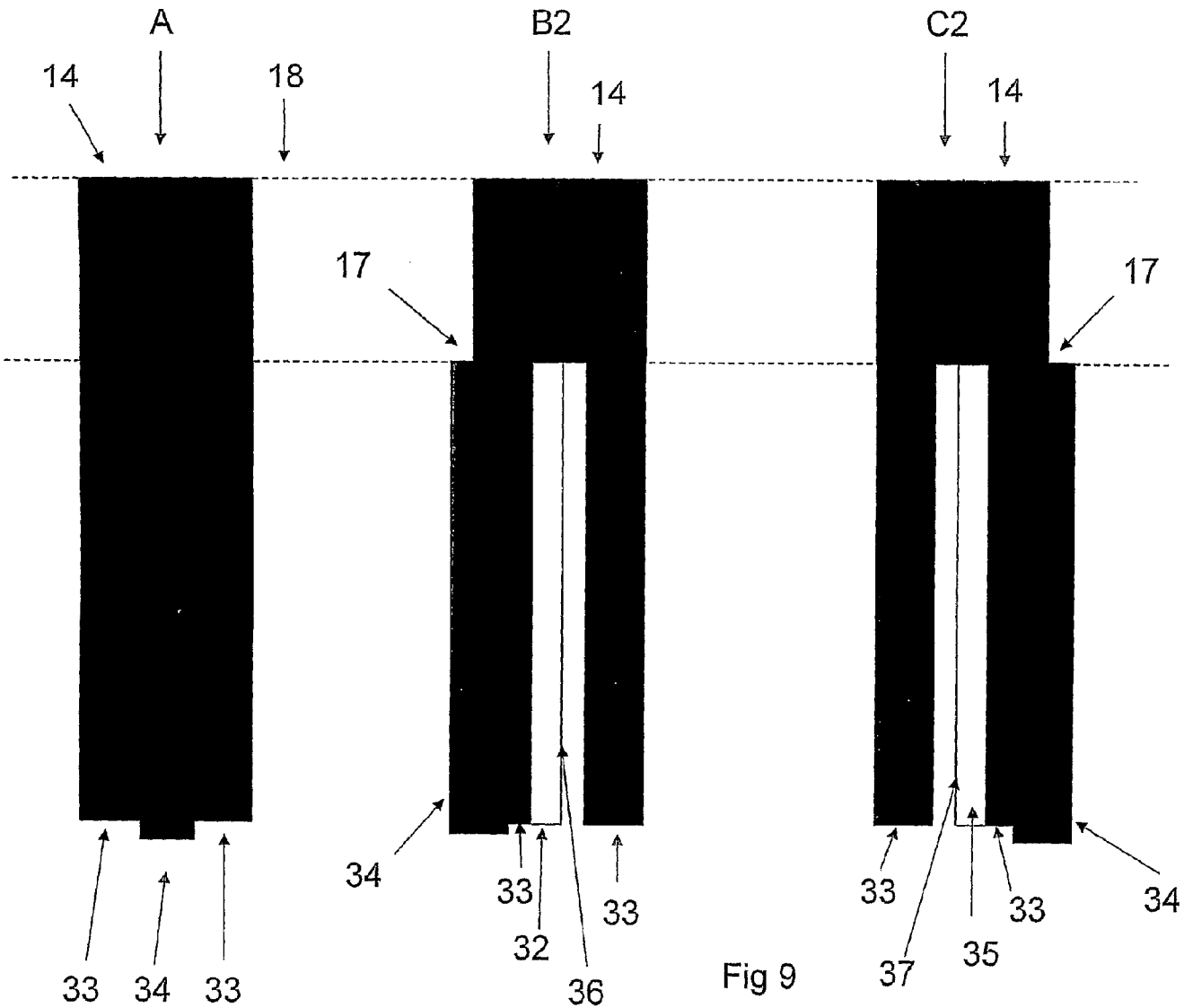
FIG. 9 is a top view of the putter head, as FIG. 8. but showing increased misalignment to either side.

FIG. 9 shows the image when further misaligned than FIG. B1 and FIG. C1 in FIG. 8. FIG. B2 shows an image where the lower elongated strip 34 is revealed to the inside and the warning strip 32 is starting to hide under the upper left side indicator bar 33. The outside edge 36 of warning strip 32 is being revealed. FIG. C2 shows an image where the lower elongated strip 34 is being revealed to the outside and the warning strip 32 is starting to hide under the upper right side indicator bar 33. The outside edge 37 of the lower left side warning strip 35 is being revealed. In both cases FIG. B2 and FIG. C2 a gap 17 is appearing making all visual clues to misalignment.

Figure 10:
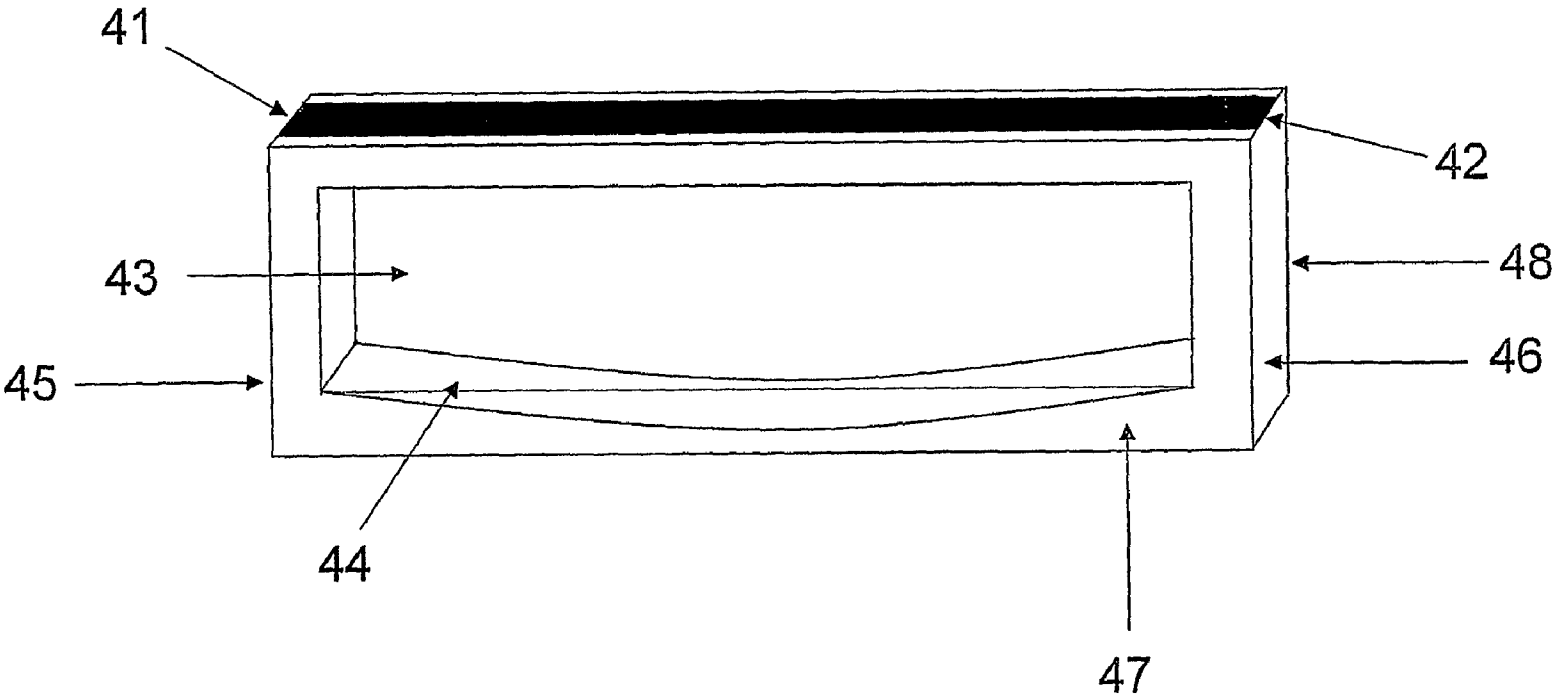
FIG. 10 is a side view, slightly in perspective of alignment system alt. 3), showing the center wall going from front to back, including the "window" of the wall.

FIG. 10 shows a third embodiment of the alignment system according to the invention. This "window" solution comprises a warning strip 44 on the lower part of a window member comprising a front frame portion 45, a back frame portion 48, a bottom frame portion 47, a top frame portion 41 defining an indicator bar 42 and a window opening 43. Warning strip 44 is the concave surface of bottom portion 47, and is the same width as indicator bar 42. This embodiment can either be used singly, or two such windows can be arranged on the alignment section of the putter, spaced apart at a distance slightly less than the width of a golf ball.

Figure 11:
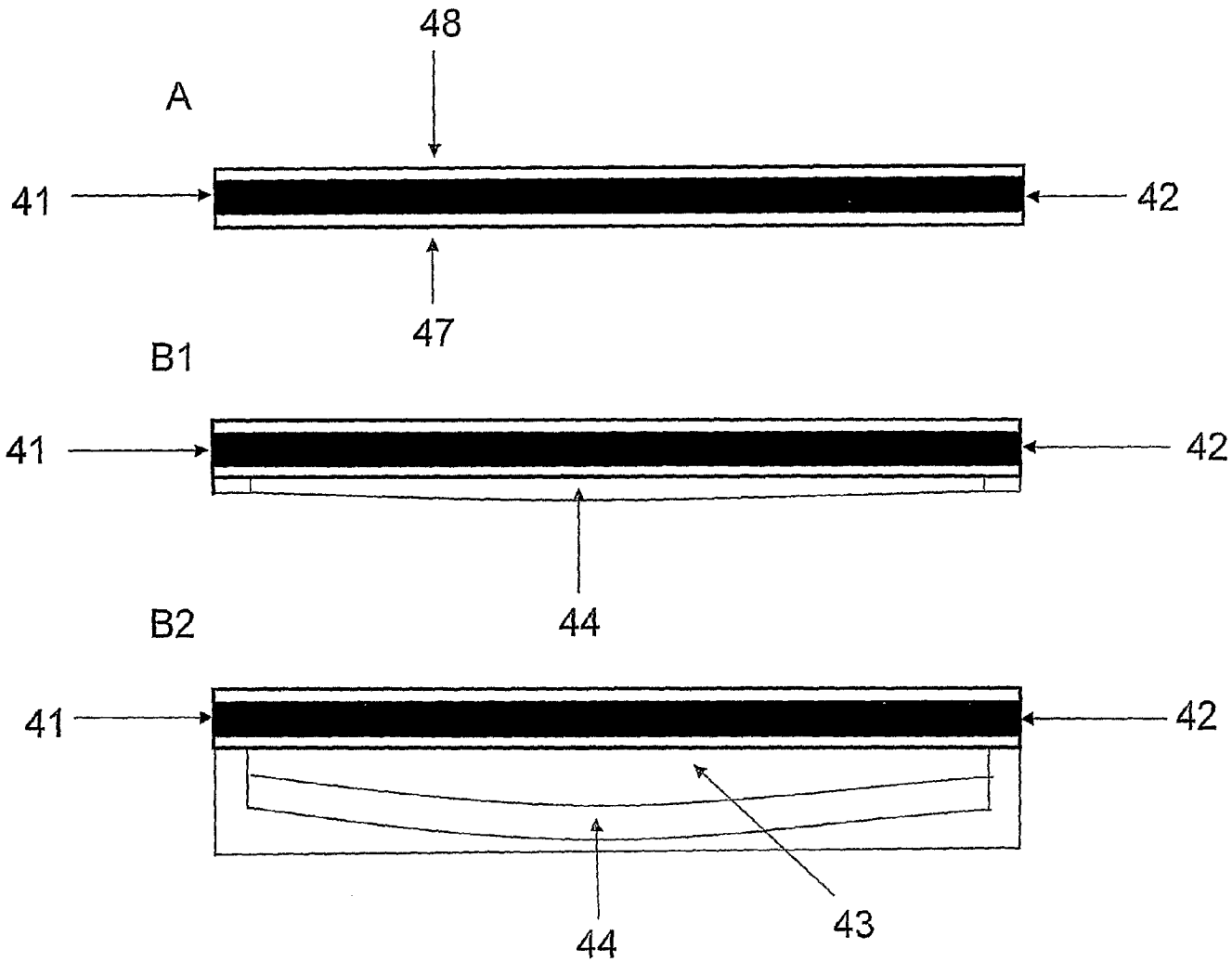
FIG. 11 is a sectional view from the top of alt. 3), of the center wall and its alignment features. Correct alignment is illustrated in (A). When misaligned the inside of the bottom of window containing the warning color starts to appear (B1). Increased misalignment is illustrated in (B2)—both with the eyes inside the putter.

FIG. 11 shows that when slightly misaligned to the inside of the center plane FIG. B1, then the warning strip 44 immediately appears. When further misaligned as in FIG. B2, then more of the warning strip 44 appears. When misaligned to the other side of the vertical plane, then the warning color appears on the same side. Because of the curved surface of warning strip 44, the misalignment will appear as bulge to the side of indicator bar 42.

How the Alignment Systems can be Manufactured

The alignment indicators could be milled or cast in the appropriate material, preferably steel or aluminum. But they could also be made as a separate part in some plastic or polycarbonate material. This way the systems would be very light; dispersing weight to the peripheral of the ornamental club head design, increasing the moment of inertia (MOI) for increased forgiveness (resisting of twisting when ball is struck off the center of the clubface). The separate part, the alignment means could then be assembled on the club head by gluing it to the exact place in which there is a gap for it on the ornamental design so that the position will be centered along the club head center line going from front to back.

The alignment indicators part would be assembled following the rules of golf equipment, so the club head will be conforming to the rules of golf when it is assembled.

The invention claimed is:

1. A putter head for a golf putter comprising a forward-facing, planar striking surface, a toe section, a heel section, a top surface and a rearward-projecting tail section, wherein the tail section comprises:

a. one or more elongated indicator bars of uniform width and color in perpendicular alignment with the striking surface arranged at a first, upper level, and b. an equal number of corresponding elongated warning strips of a contrasting color, each having approximately the same width as its respective indicator bar, and being arranged in vertical alignment with its respective indicator bar at a second, lower level, and further wherein one or more elongated strips of uniform width and having the same color as the indicator bar or bars are arranged at the lower level adjacent to the warning strip or strips, and that the top surface is provided with a rectangular marking having the same color as, and being centered with, the indicator bar or bars, and having a width approximately equal to the combined widths of the warning strips and elongated strips of the lower level.

2. A putter head according to claim 1, wherein one indicator bar is arranged at the first, upper level, and that one warning strip is arranged at the second lower level intermediate two adjacent elongated strips.

3. A putter head according to claim 1, wherein two indicator bars are arranged at the first, upper level, the bars being spaced apart at a distance approximately equal to their widths, that two warning strips are arranged at the second, lower level and that one elongated strip is arranged intermediate the two warning strips.

4. A putter head according to either of claims 2 or 3, wherein the elongated strip or strips represent the upper surface of an elongated member or members having a raised cross sectional profile, and that the warning strip or strips represent the upper surface of a groove or trough.

5. A putter head according to claim 1, wherein said tail section comprises at least one vertically oriented window member having a front frame portion, a back frame portion, a top frame portion and a bottom frame portion, and wherein the elongated indicator bars represents the upper surface of the top frame portion of the window member and the warning strip represents the upper surface of the bottom frame portion of the window member.

6. A putter according to claim 5 wherein the upper surface of the bottom frame portion is concave.

7. A putter head comprising a forward-facing, planar striking surface, a toe section, a heel section, a top surface and a rearward-projecting tail section, wherein said tail section comprises at least one vertically oriented window member extending rearwardly from the planar striking surface, said window member comprising an opening enclosed by a frame, said frame having a front frame portion, a back frame portion, a rearwardly extending top frame portion and a rearwardly extending bottom frame portion, and wherein the upper surface of the top frame portion of the window member has approximately the same width as, and vertically aligned with the bottom frame portion such that it is arranged to completely obscure the upper surface of the bottom frame portion of the window member when the eyes of a users are vertically aligned with said top and bottom frame members.

8. A putter according to claim 7 wherein the upper surface of the bottom frame portion is concave along its length.

* * * * *